US008801456B2

(12) United States Patent
Miyakawa et al.

(10) Patent No.: US 8,801,456 B2
(45) Date of Patent: Aug. 12, 2014

(54) CONNECTOR

(71) Applicant: Yazaki Corporation, Tokyo (JP)

(72) Inventors: Tomoyuki Miyakawa, Utsunomiya (JP); Naoto Sugie, Makinohara (JP); Kazuto Ohtaka, Makinohara (JP); Hideki Homma, Tokyo (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/770,400

(22) Filed: Feb. 19, 2013

(65) Prior Publication Data

US 2013/0164996 A1 Jun. 27, 2013

Related U.S. Application Data

(63) Continuation of application No. PCT/JP2011/068495, filed on Aug. 9, 2011.

(30) Foreign Application Priority Data

Aug. 20, 2010 (JP) ..... 2010-185161

(51) Int. Cl.
*H01R 13/58* (2006.01)
*H01R 13/506* (2006.01)

(52) U.S. Cl.
CPC ..... *H01R 13/506* (2013.01)
USPC ..... 439/466; 439/852

(58) Field of Classification Search
CPC .... H01R 13/506; H01R 12/78; H01R 13/567; H01R 13/6275; H01R 13/113; H01R 23/725
USPC ..... 439/466, 496, 685, 686, 352, 852
See application file for complete search history.

(56) References Cited

U.S. PATENT DOCUMENTS

| | | | | |
|---|---|---|---|---|
| 5,616,045 | A * | 4/1997 | Gauker | 439/352 |
| 5,816,840 | A * | 10/1998 | Dullin | 439/352 |
| 6,250,952 | B1 * | 6/2001 | Shiga et al. | 439/466 |
| 6,551,137 | B2 * | 4/2003 | Pfaff et al. | 439/108 |
| 2002/0160645 | A1 | 10/2002 | Nagamine et al. | |

FOREIGN PATENT DOCUMENTS

JP 2002-324638 A 11/2002

OTHER PUBLICATIONS

International Search Report for PCT/JP2011/068495, dated Oct. 18, 2011 [PCT/ISA/210].
Written Opinion for PCT/JP2011/068495, dated Oct. 18, 2011 [PCT/ISA/237].

* cited by examiner

*Primary Examiner* — Phuong Dinh
(74) *Attorney, Agent, or Firm* — Sughrue Mion, PLLC

(57) ABSTRACT

A connector includes a housing to be inserted into a receiving chamber of an initiator, a plurality of terminal receiving chambers which are opened to a distal end face of the housing in parallel with each other in a row, and terminals respectively provided with pin inserting parts into which pins in the receiving chamber are inserted, and respectively received in the terminal receiving chambers. Each of the pin inserting parts has an elastic contact piece which is elastically contacted with the pin which has been inserted into the pin inserting part thereby to hold the pin in the pin inserting part. The terminals are received in the terminal receiving chambers so that the elastic contact pieces push the pins in a direction which is the same as a direction to which the terminal receiving chambers are arranged.

5 Claims, 7 Drawing Sheets

CONNECTOR

CROSS REFERENCE TO RELATED APPLICATION

This application is a continuation of PCT application No. PCT/JP2011/068495, which was filed on Aug. 9, 2011 based on Japanese Patent Applications No. 2010-185161 filed on Aug. 20, 2010, the contents of which are incorporated herein by reference. Also, all the references cited herein are incorporated as a whole.

BACKGROUND OF THE INVENTION

1. Technical Field

The present invention relates to a connector in which a plurality of terminal receiving chambers for receiving terminals are opened to a distal end face of a housing to be inserted into a receiving chamber of an initiator.

2. Background Art

A connector of this type is disclosed in JP-A-2002-324638 as described below. In an electrically connecting device in JP-A-2002-324638, when a center plug part of a second component (a housing) is inserted into a socket (a receiving chamber) of a first component (an initiator), a pin in the socket is inserted into the center plug part from an opening which is provided on a distal end face of the center plug part, and the pin is connected to an electric terminal in the center plug part.

Technical problem in the connector disclosed in JP-A-2002-324638 is discussed below.

SUMMARY OF THE INVENTION

That is, in the above described conventional connector, in case where the center plug part is inserted in an inclined state with respect to the socket, there has been such anxiety that the pin may be deformed, because a tip end of the pin is butted against a corner part of the opening of the center plug part.

The invention has been made in view of such a problem, and an object of the invention is to provide a connector in which a pin in a receiving chamber can be prevented form being deformed, when the pin is butted against a housing which is inserted into the receiving chamber.

According to an aspect of the invention, a connector includes a housing to be inserted into a receiving chamber of an initiator, a plurality of terminal receiving chambers which are opened to a distal end face of the housing in parallel with each other in a row, and terminals respectively provided with pin inserting parts into which pins in the receiving chamber are inserted, and respectively received in the terminal receiving chambers. Each of the pin inserting parts has an elastic contact piece which is elastically contacted with the pin which has been inserted into the pin inserting part thereby to hold the pin in the pin inserting part. The terminals are received in the terminal receiving chambers so that the elastic contact pieces push the pins in a direction which is the same as a direction to which the terminal receiving chambers are arranged.

Moreover, the invention is characterized in that each of the pin inserting parts is provided with a stamped out part for clamping the pin in cooperation with the elastic contact piece.

According to the invention, a height of an engaging frontage of the housing to be engaged with the initiator is depressed to be low, and hence, the pins can be prevented from being deformed due to contact between the housing and the pins, when the housing is inserted into the initiator.

DETAILED DESCRIPTION OF THE EXEMPLARY EMBODIMENTS

Figure 1:
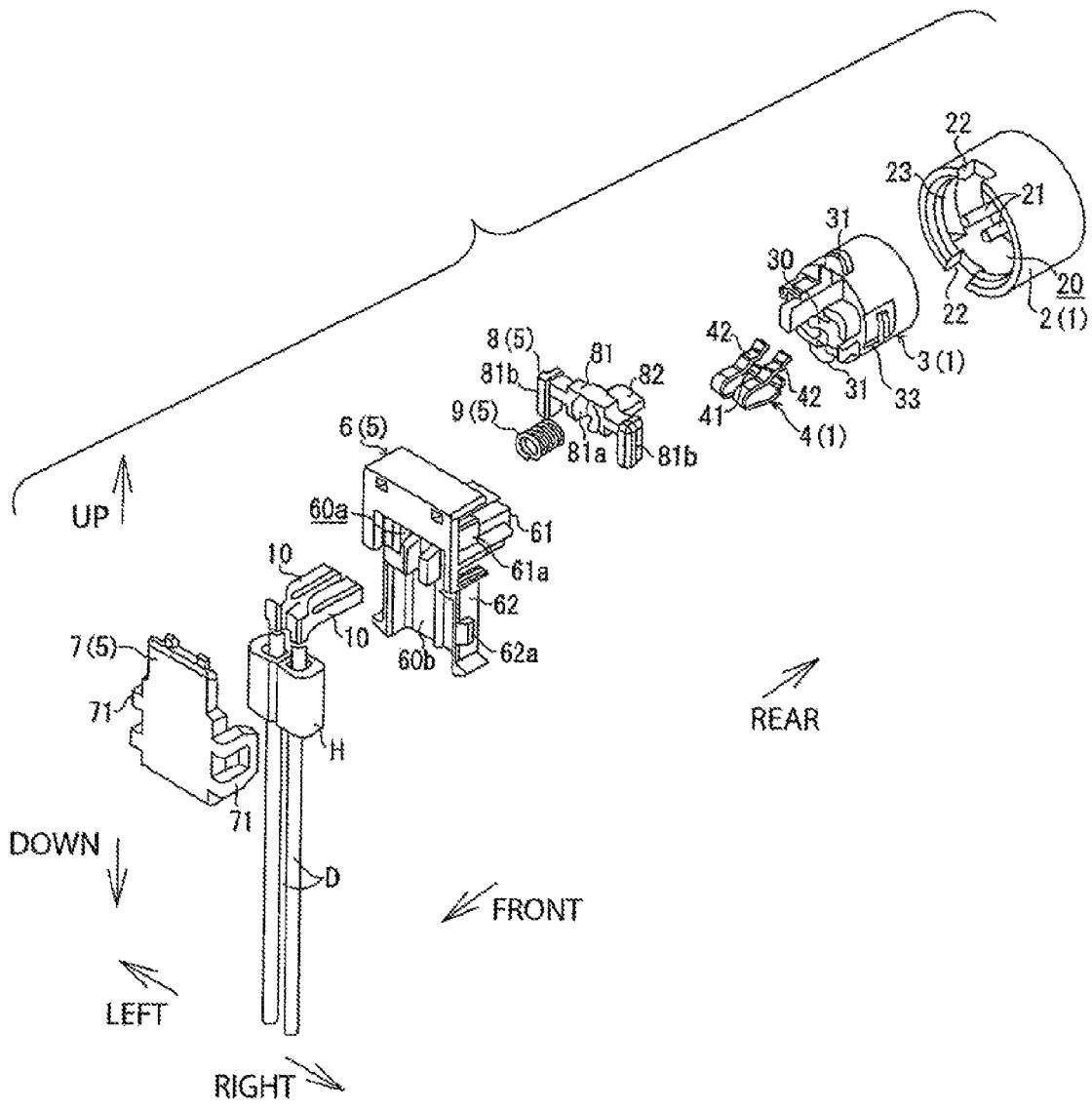
FIG. 1 is an exploded perspective view of a connector in an embodiment according to the invention, as seen from above.

Now, an embodiment according to the invention will be described referring to the drawings.

Figure 2A:
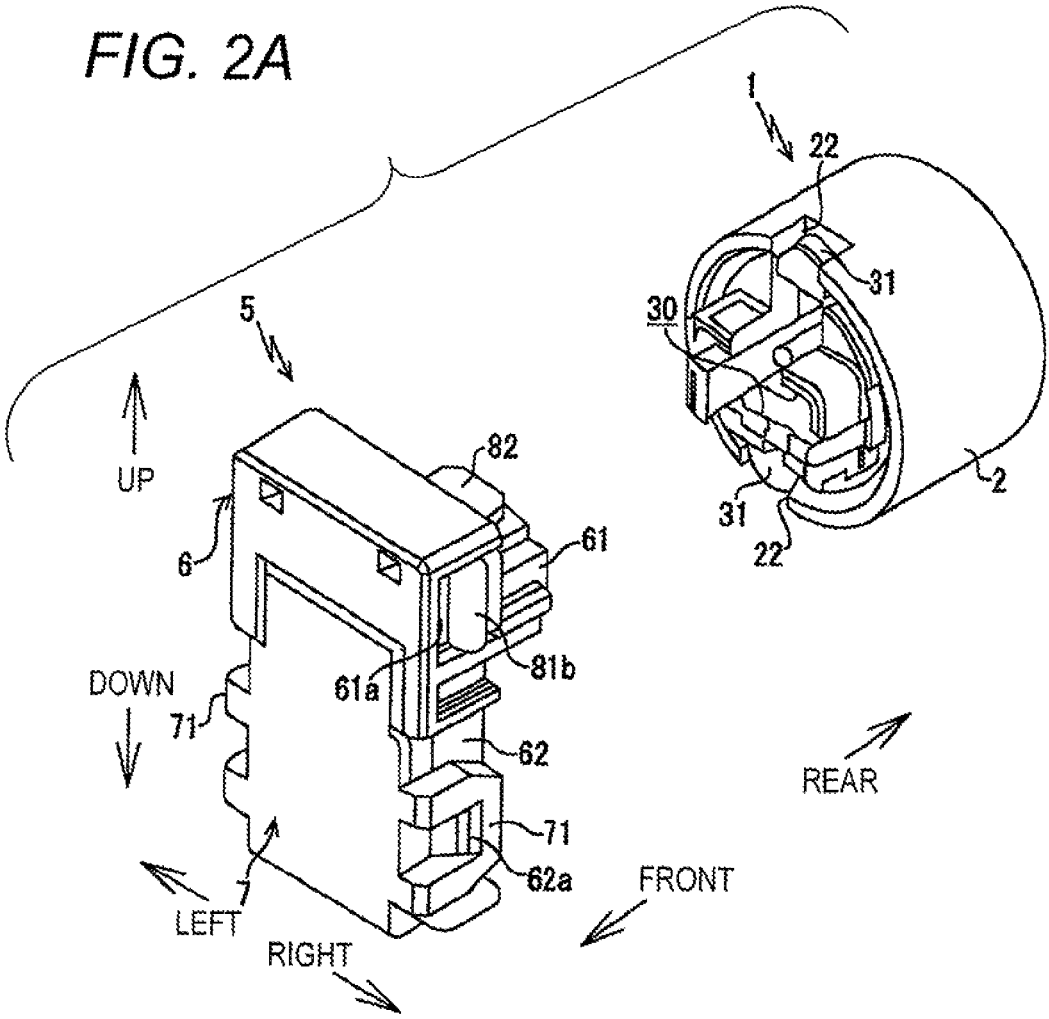
FIG. 2A is a perspective view of the connector as seen from the above, before a housing is assembled to an initiator.
Figure 2B:
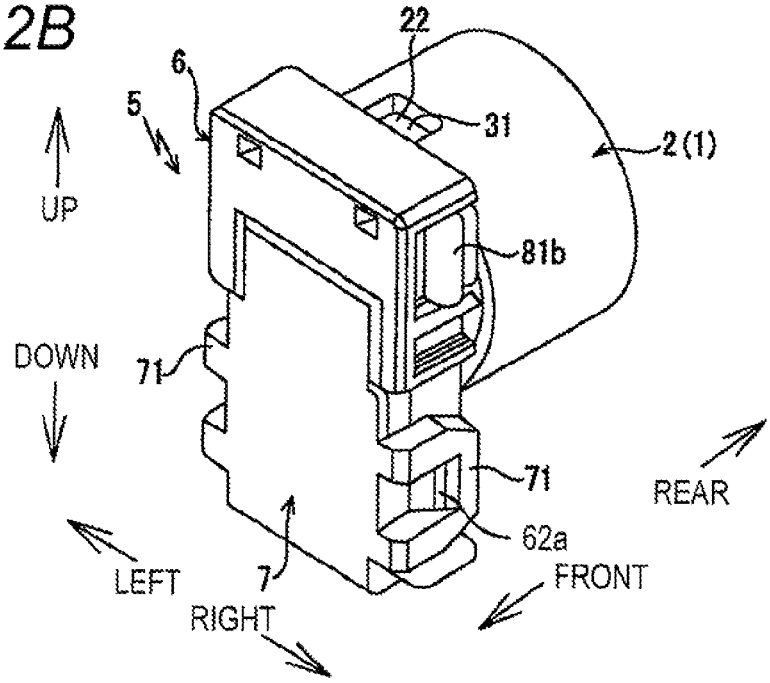
FIG. 2B is a perspective view of the connector as seen from the above, after the housing has been assembled to the initiator.

FIGS. 1, 2A and 2B are views showing a connector in the embodiment. FIG. 1 is an exploded perspective view as seen from the above, and FIGS. 2A and 2B are perspective views. Directions such as "up and down", "front and rear", and "right and left" to be used in the following description are shown in the respective drawings which are referred to in the description. It is apparent that these "up and down", "front and rear", and "right and left" are shown only for explanation, and may be different from actual arrangements.

As shown in FIGS. 1, 2A and 2B, the connector includes an initiator 1 and a housing 5. The initiator 1 has a main body 2 in a shape of a bottomed cylinder, and a shunt 3 in a columnar shape which is received in the main body 2. A receiving chamber 20 for receiving the shunt 3 is opened to a front face of the main body 2. A pair of pins 21 are extended forward from a bottom face of the receiving chamber 20 in parallel with each other in a lateral direction. Moreover, locking recesses 23 are respectively formed on right and left inner side faces of the receiving chamber 20. Further, engaging recesses 22 are respectively formed on an upper edge and a lower edge of the opening at the front end of the receiving chamber 20.

The shunt 3 is provided with an insertion hole 30 which passes through the shunt 3 from a front end face to a rear end face thereof. A short-circuit fitting 4 as shown in FIG. 1 is fitted into the insertion hole 30. The short-circuit fitting 4 has a locking piece 41 which is locked into the insertion hole 30, and contact pieces 42 which are elastically contacted with the two pins 21 extending through the insertion hole 30.

Figure 5A:
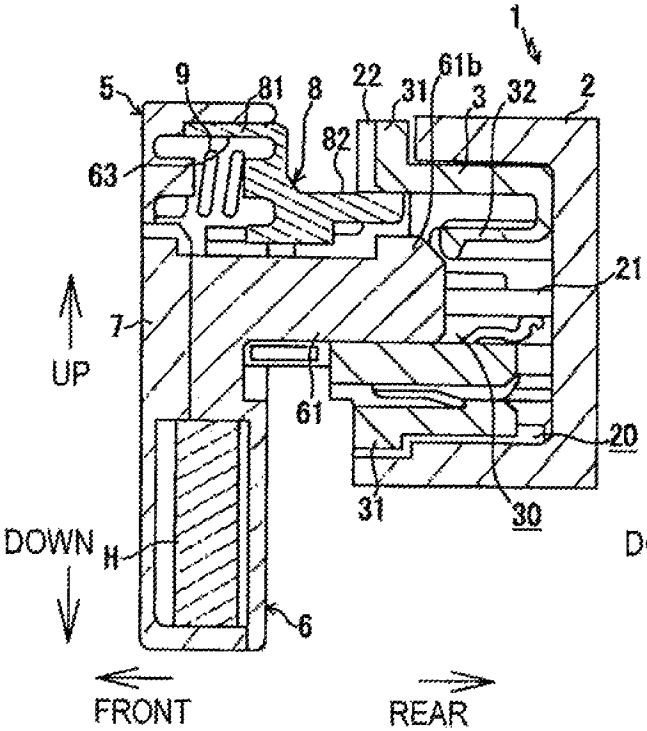
FIGS. 5A to 5C are longitudinal sectional views taken along a longitudinal direction, showing assembling operation of the housing to the initiator.
Figure 5B:
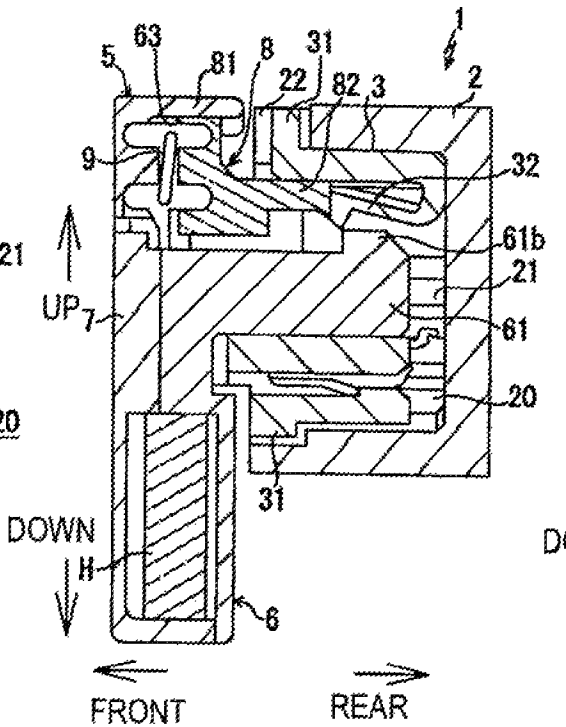
Figure 5C:
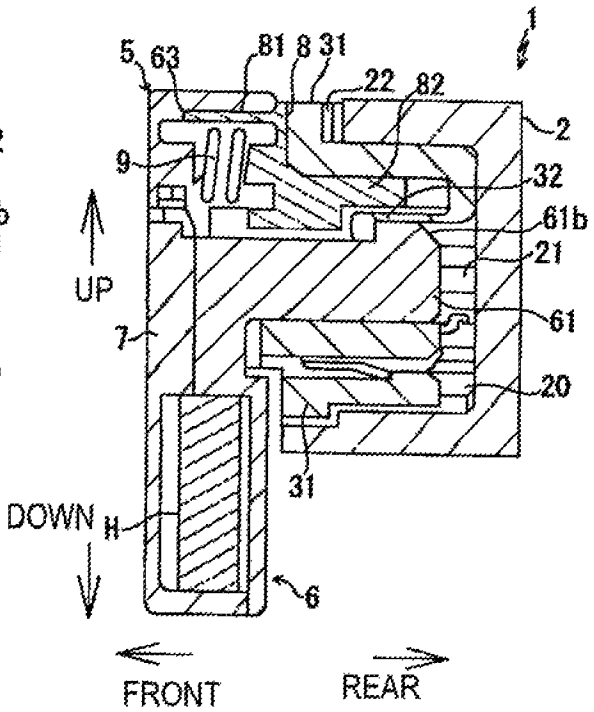

As shown in FIG. 1, locking pieces 33 are respectively extended from right and left side faces of the shunt 3. The locking pieces 33 are bent outward from the shunt 3 and extended forward. Moreover, engaging projections 31 are respectively provided on upper and lower side faces of the shunt 3. As shown in FIGS. 5A to 5C, a locking arm 32 is extended forward from a rear end of an upper edge of the insertion hole 30.

As shown in FIGS. 2A and 2B, the shunt 3 is received in the receiving chamber 20, and the engaging projections 31 are engaged with the engaging recesses 22. In the shunt 3 which is received in the receiving chamber 20, the locking pieces 33 are locked to the locking recesses 23. Moreover, as shown in FIGS. 5A to 5C, a rear end face of the shunt 3 is in contact with the bottom face of the receiving chamber 20, and the pins 21 in the main body 2 are extended through the insertion hole 30 toward a front end thereof.

As shown in FIG. 1, the housing 5 includes a housing body 6 to which terminals 10 are fitted, and a cover 7 which covers the housing body 6 from the front. A terminal receiving part 61 in a shape of a square block is extended backward from a rear face of the housing body 6, and a wire receiving part 62 is extended downward from a lower face of the housing body 6. The terminal receiving part 61 has terminal receiving chambers 60*a* for receiving the terminals 10, which are opened to a front face and a rear face of the terminal receiving part 61 in parallel with each other in a lateral direction.

As shown in FIGS. 5A to 5C, a terminal receiving chamber 63 for receiving a slider 8, which will be described below, is opened to the rear face of the housing body 6 which is positioned above an extended position of the terminal receiving part 61. Moreover, locking projections 61*b* are provided on an upper face of a rear end region of the terminal receiving part 61. Although not shown in the drawings, a pair of terminal locking arms are provided in parallel with each other in the lateral direction, in front of the locking projections 61*b* on the upper face of the terminal receiving part 61.

As shown in FIG. 1, the wire receiving part 62 is extended downward from a lower edge of the housing body 6, and provided with locking projections 62*a* on its right and left side faces. The wire receiving part 62 has a wire receiving chamber 60*b* for receiving a ferrite H through which electric wires D of the terminals are passed, together with the electric wires D.

The slider 8 is engaged with the terminal receiving part 61. As shown in FIG. 1, the slider 8 includes a spring receiving part 81 having a spring receiving chamber 81*a* which is opened to its front face, and a movement restricting piece 82 which is extended backward from a lower end of the spring receiving part 81. A pair of slide parts 81*b* are extended laterally from right and left side faces of the spring receiving part 81. Moreover, guide parts 61*a* for guiding the slide parts 81*b* in the longitudinal direction are provided on right and left side faces of the housing body 6.

As shown in FIGS. 2A and 2B, the slider 8 is engaged with the housing body 6 so as to slide in the longitudinal direction, in such a manner that the spring receiving part 81 covers the upper face and the right and left side faces of the terminal receiving part 61. As shown in FIGS. 5A to 5C, the spring receiving part 81 of the slider 8 is received in the terminal receiving chamber 63. One end of a spring 9 is received in the spring receiving chamber 81*a*, while the other end is protruded forward from the spring receiving chamber 81*a*.

As shown in FIGS. 2A and 2B, the cover 7 is fitted to the housing body 6, by locking a pair of right and left locking parts 71 provided at its lower end to the locking projections 62*a* of the housing body 6. The cover 7 which is fitted to the housing body 6 presses the terminals into the terminal receiving chambers 60*a* from the front, and presses the ferrite H to an inner face of the wire receiving chamber 60*b* from the front so that the terminals 10 and the ferrite H are clamped between the cover 7 and the housing body 6.

Figure 3A:
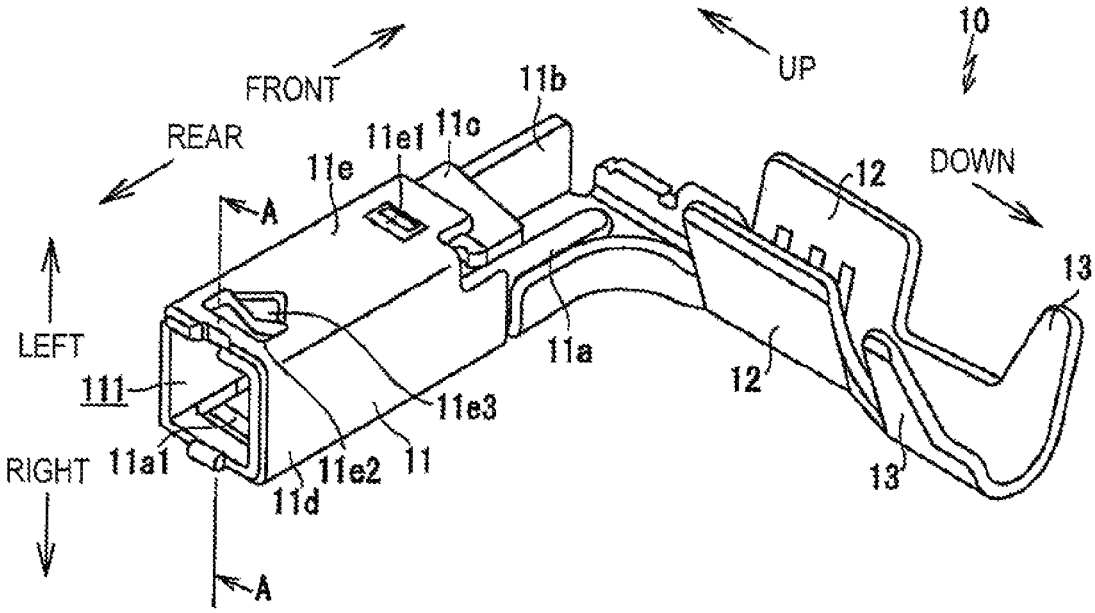
FIG. 3A is a view showing a terminal which is assembled to the housing, as seen from a backward left side.
Figure 3B:
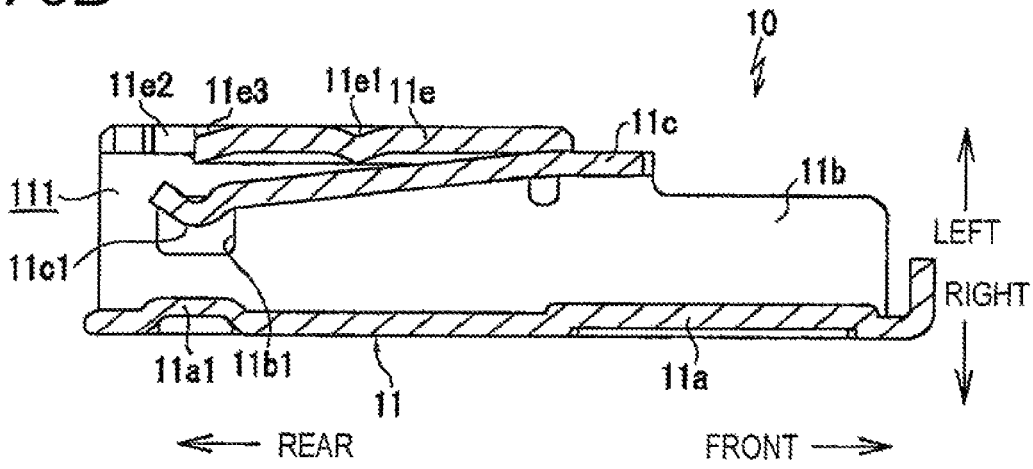
FIG. 3B is a sectional view taken along a line A-A in FIG. 3A.
Figure 4A:
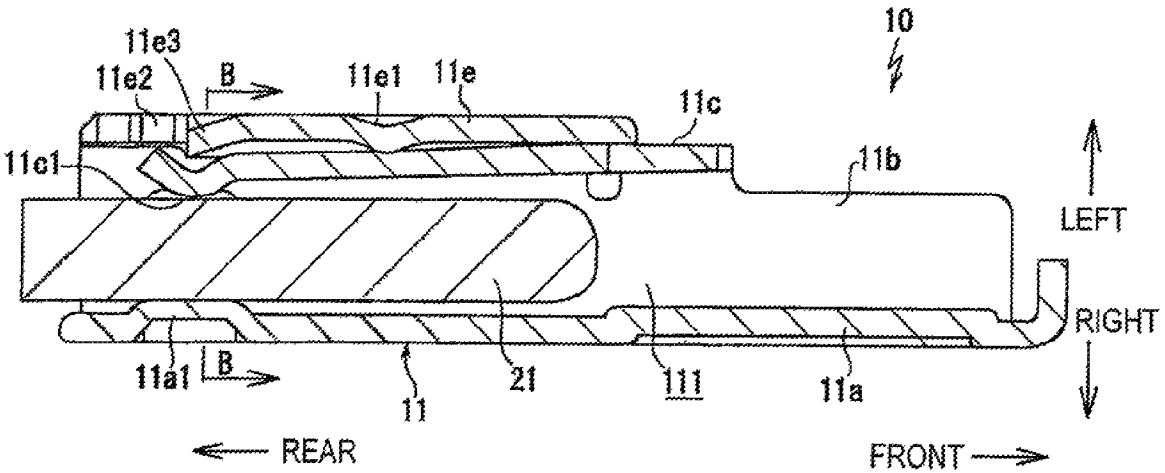
FIG. 4A is a sectional view taken along a line A-A in FIG. 3A, showing a state where a pin is connected to the terminal which has been assembled to the housing.
Figure 4B:
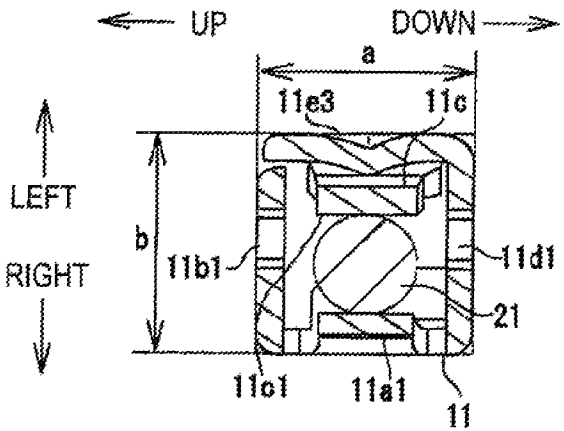
FIG. 4B is a sectional view taken along a line B-B in FIG. 4A.

Then, the terminals 10 to be received in the terminal receiving chambers 60*a* of the terminal receiving part 61 will be described. FIGS. 3A and 3B are views showing one of the terminals 10, and FIGS. 4A and 4B are views showing a state where the pin is connected to the terminal.

The terminal 10 as shown in FIGS. 3A and 3B are formed by folding a flat metal plate, and includes a pin inserting part 11, a wire barrel 12 to be wound around a core wire of an electric wire, and an insulation barrel 13 to be wound around a covering part of the electric wire.

As shown in FIGS. 3A and 3B, the pin inserting part 11 has a pin inserting chamber 111 in a square cylindrical shape extending in the longitudinal direction which is defined by a right wall 11*a*, an upper wall 11*b*, a lower wall 11*d*, and a left wall 11*e*. The left wall 11*e* is provided with a support part 11*e*1, an insertion hole 11*e*2, and a restricting part 11*e*3. The support part 11*e*1 is provided in a front end part of the left wall 11*e*, and formed by inwardly bending the left wall 11*e*. The insertion hole 11*e*2 is provided in a rear end part of the left wall 11*e*, passing through the left wall 11*e* from an inside to an outside. The restricting part 11*e*3 is provided in a front edge part of the insertion hole 11*e*2, and formed by inwardly bending the left wall 11*e*.

A stamped out part 11*a*1 is provided in a rear end part of the right wall 11*a* of the pin inserting part 11. The stamped out part 11*a*1 is formed by stamping the right wall 11*a* to be bent inwardly, and positioned at a position opposed to the insertion hole 11*e*2 and the restricting part 11*e*3. The upper wall 11*b* and the lower wall 11*d* of the pin inserting part 11 are provided with through holes 11*b*1 and 11*d*1 (See FIGS. 4A and 4B), although omitted in FIGS. 3A and 3B. The through holes 11*b*1 and 11*d*1 pass through the upper wall 11*b* and the lower wall 11*d* from the inside to the outside, and arranged at the same positions in the longitudinal direction as the stamped out part 11*a*1, the insertion hole 11*e*2, and the restricting part 11*e*3.

An elastic contact piece 11*c* is extended from a left edge of the upper wall 11*b* to the inside of the left wall 11*e*. The elastic contact piece 11*c* is extended from the left edge of a front end part of the upper wall 11*b* to the inside of the left wall 11*e*, having its rear end part inclined toward the right wall 11*a*. A butting part 11*c*1 which is formed by bending the elastic contact piece 11*c* from its outer face side to the inside is provided in the rear end part of the elastic contact piece 11*c*.

As shown in FIGS. 4A and 4B, in the pin inserting part 11, the butting part 11*c*1 of the elastic contact piece 11*c* is butted against an outer peripheral face of the pin 21 which has been inserted into the pin inserting chamber 111 from an opening at its rear end, and the pin 21 is clamped between the stamped out part 11*a*1 and the butting part 11*c*1 thereby to be held in the pin inserting chamber 111. The elastic contact piece 11*c* with the butting part 11*c*1 butted against the pin 21 is butted against the support part 11*e*1 at a center part in the longitudinal direction of its outer face. When the pin 21 is inserted into the pin inserting part 11 in a laterally inclined state, the rear end of the elastic contact piece 11*c* is butted against the restricting part 11*e*3. As shown in FIG. 4B, in the terminal 10, an occupying space b in the lateral direction in which the stamped out part 11*a*1 and the elastic contact piece 11*c* are arranged in parallel is larger than an occupying space a in the vertical direction.

Then, operation for mounting the housing 5 to the initiator 1 will be described. In order to mount the housing 5 to the initiator 1, the terminal receiving part 61 is inserted into the insertion hole 30, as shown in FIG. 5A. The locking arm 32 of the shunt 3 overrides the locking projection 61*b* of the terminal receiving part 61, allowing its distal end to be butted against the movement restricting piece 82 of the slider 8, as shown in FIG. 5B, thereby to press the slider 8 backward. Accordingly, the slide parts 81*b* of the slider 8 are guided by the guide parts 61*a*, and the slider 8 moves forward with respect to the housing body 6, while compressing the spring 9. Thereafter, the pin 21 of the initiator 1 is connected to the terminal 10 in the terminal receiving chamber 60*a*, and the locking arm 32 is locked to the locking projection 61*b*, as shown in FIG. 5C. Then, the slider 8 moves backward with resiliency of the spring 9, and the movement restricting piece 82 is positioned above the locking arm 32. In this manner, upward movement of the locking arm 32 is restricted by the movement restricting piece 82.

Figure 6A:
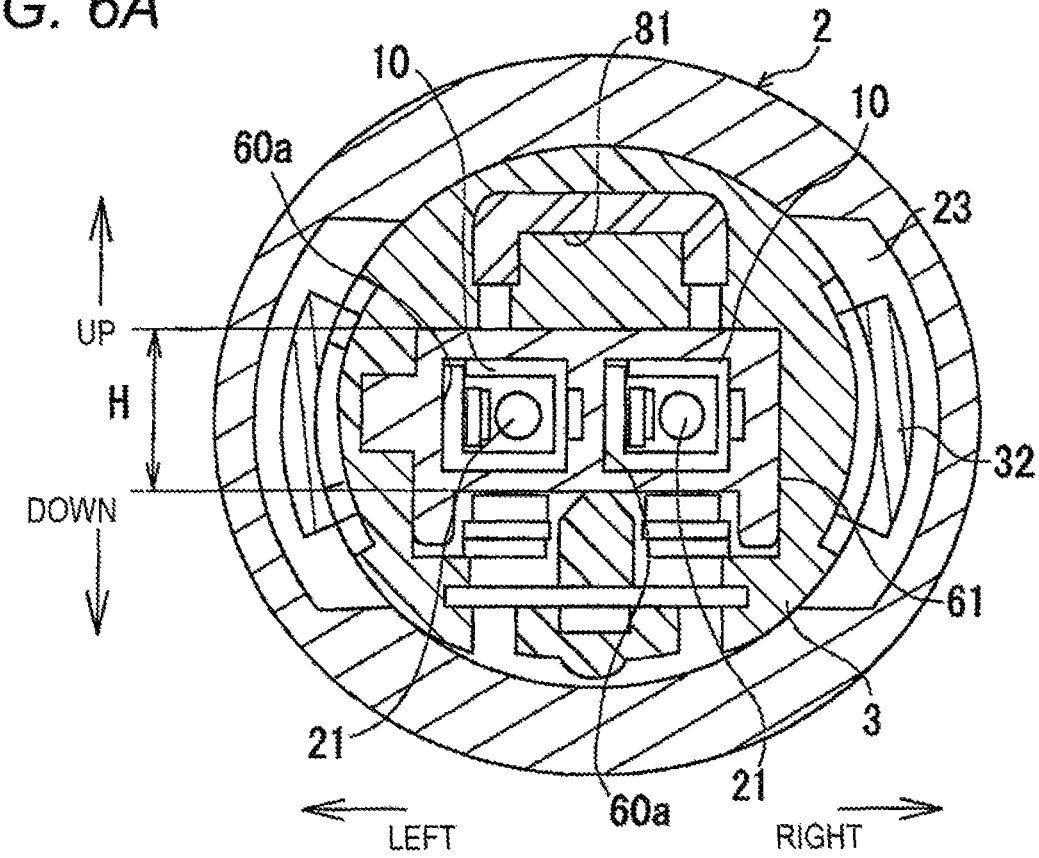
FIG. 6A is a sectional view taken along a direction perpendicular to the longitudinal direction in FIG. 2B.
Figure 6B:
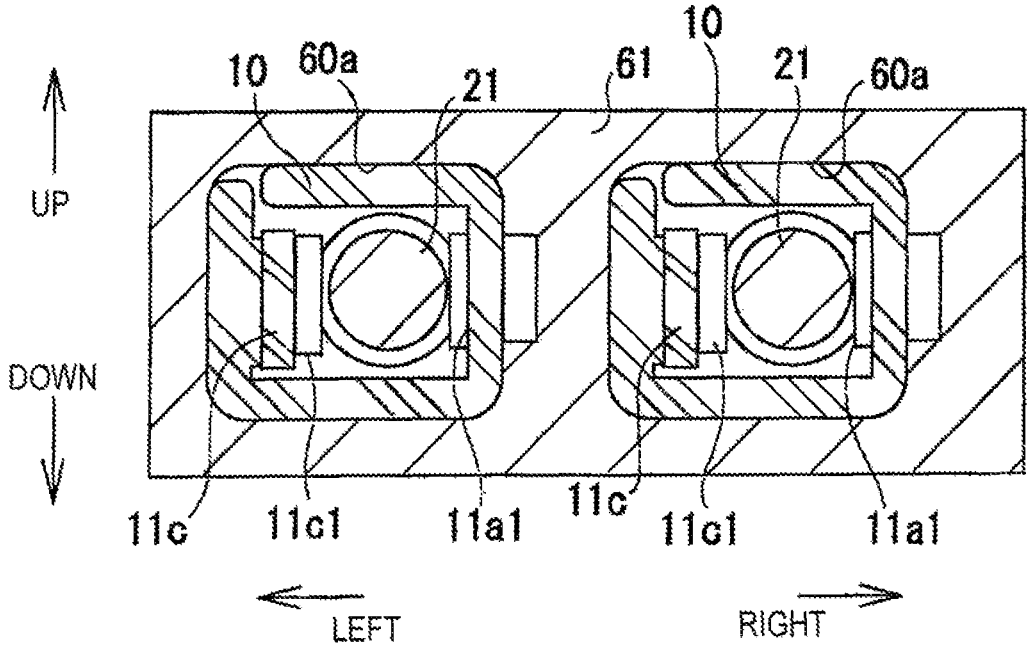
FIG. 6B is a sectional view showing terminal receiving chambers in a partially enlarged state.
Figure 7:
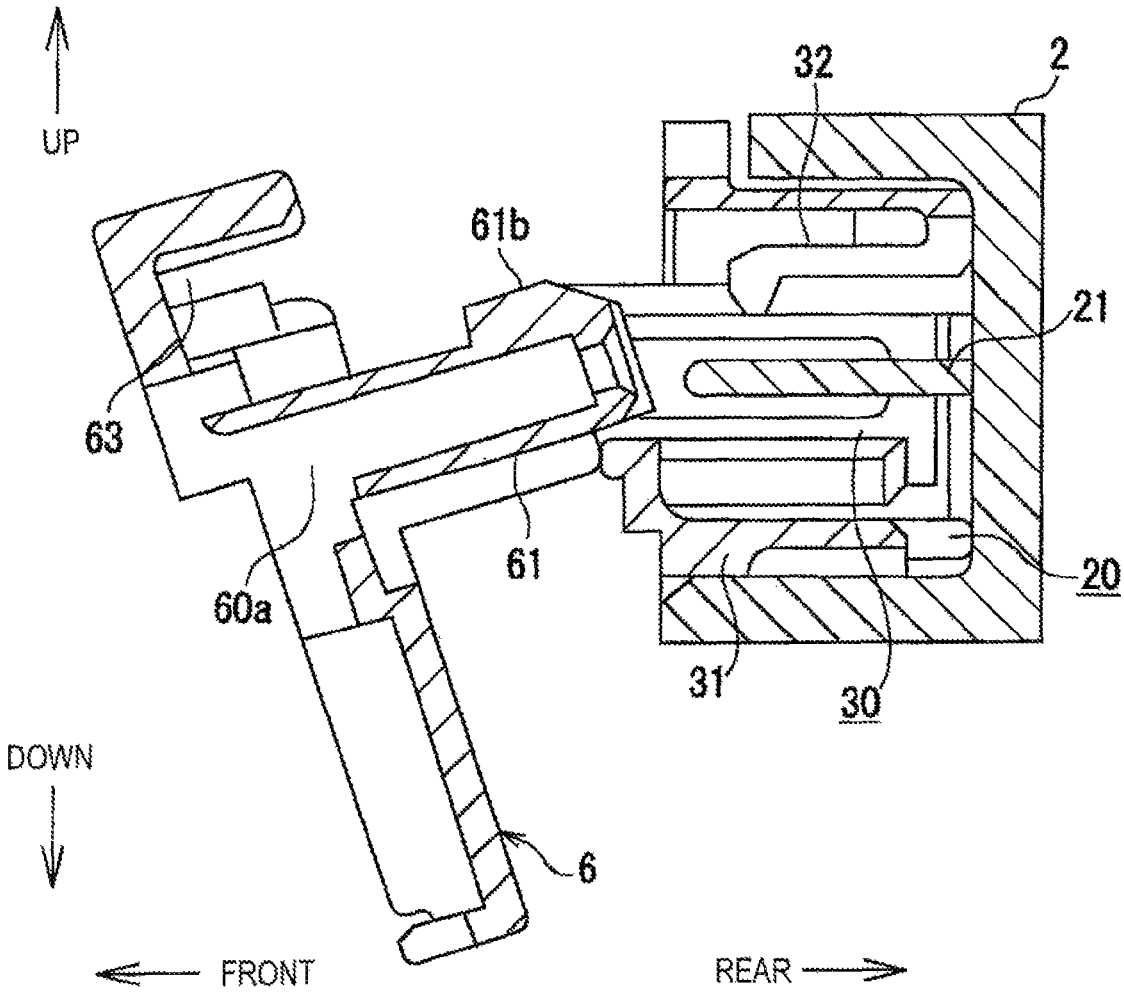
FIG. 7 is a longitudinal sectional view taken along the longitudinal direction, showing a state where the terminal receiving part provided in the housing is inclined, when it is inserted into a receiving chamber provided in a shunt of the initiator.

The terminals 10 which are constructed as described above, are respectively received in the terminal receiving chambers 60*a* which are arranged in parallel in the lateral direction in the terminal receiving part 61, as shown in FIGS. 6A and 6B, in a state where outer faces of the left walls 11*e* are in tight contact with the left inner wall faces of the terminal receiving chambers 60*a*. Specifically, the terminals 10 are received in the terminal receiving chambers 60*a* in such a manner that the stamped out parts 11*a*1 and the elastic contact pieces 11*c* are arranged in the same lateral direction as the direction in which the terminal receiving chambers 60*a* are arranged. Because the occupying space b of the terminal 10 in the lateral direction is larger than the occupying space a in the vertical direction, a height H of an engaging frontage can be made smaller, as compared with a case where the stamped out part 11*a*1 and the elastic contact piece 11*c* are arranged in the vertical direction interposing the pin 21. Therefore, even though the terminal receiving part 61 is inserted into the insertion hole 30 in a state where the housing 5 is inclined in the vertical direction, as shown in FIG. 7, moving amounts of the upper edges and the lower edges of the terminal receiving chambers 60*a* are depressed to be small with respect to the vertical inclination of the housing 5. As the results, the pins 21 are prevented from being deformed due to contact between corner parts of the upper edges and the lower edges of the terminal receiving chambers 60*a* and the pins 21.

According to this embodiment, the terminals 10 are received in the terminal receiving chambers 60*a* in such a manner that the elastic contact pieces 11*c* which are elastically contacted with the pins 21 which have been inserted into the pin inserting part 11 may be arranged in the arranging direction of the terminal receiving chambers 60*a*. Therefore, the height of the engaging frontage can be depressed to be low, and the moving amounts of the upper edges and the lower edges of the terminal receiving chambers 60*a* with respect to the vertical inclination of the housing 5 can be depressed to be small. Moreover, because the stamped out parts 11*a*1 for clamping the pins 21 in cooperation with the elastic contact pieces 11*c* are also arranged in the arranging direction of the terminal receiving chambers 60*a*, the moving amounts of the upper edges and the lower edges of the terminal receiving chambers 60*a* with respect to the vertical inclination of the housing 5 can be depressed to be small. Accordingly, the pins 21 can be prevented from being deformed due to contact between the corner parts of the upper edges and the lower edges of the terminal receiving chambers 60*a* and the pins 21. Accordingly, the terminals 10 can be brought into contact with the pins 21 accurately.

In the above described embodiment, the invention has been described referring to the case where the two terminal receiving chambers 60*a* are opened to the rear end face of the terminal receiving part 61 in parallel with each other in the lateral direction. However, the number of the terminal receiving chambers 60*a* which are opened to the rear end face of the terminal receiving part 61 is optional, and three or more terminal receiving chambers 60*a* may be opened. Moreover, the terminal receiving chambers 60*a* may be opened in parallel not only in the lateral direction but also in the vertical direction. Further, in the above described embodiment, the invention has been described referring to the case where the elastic contact pieces 11*c* of the two terminals 10 are directed in the same direction. However, the elastic contact pieces 11*c* may be arranged at the opposite sides interposing the two pins 21. Still further, in the above described embodiment, the invention has been described referring to the case where there is provided the stamped out part 11*a*1 for clamping the pin 21 in cooperation with the elastic contact piece 11*c*. However, the stamped out part 11*a*1 may be omitted.

The present application is based on Japanese patent application No. 2010-185161, the contents of which are incorporated herein by reference.

INDUSTRIAL APPLICABILITY

According to the invention, the height of the engaging frontage of the housing engaged with the initiator can be low.

What is claimed is:

1. A connector comprising:

a housing to be inserted into a receiving chamber of an initiator, a plurality of terminal receiving chambers which are opened to a distal end face of the housing in parallel with each other in a row, and terminals respectively provided with pin inserting parts into which pins in the receiving chamber are inserted, and respectively received in the terminal receiving chambers, wherein each of the pin inserting parts has an elastic contact piece which is elastically contacted with the pin which has been inserted into the pin inserting part thereby to hold the pin in the pin inserting part, wherein the elastic contact pieces have a butting part formed at a rear end of the elastic contact pieces so that the butting part is disposed between the rear end of the elastic contact piece and the pin when the pin is inserted into the pin inserting part, and the terminals are received in the terminal receiving chambers so that the elastic contact pieces push the pins in a direction which is the same as a direction in which the terminal receiving chambers are arranged.

2. The connector according to claim 1, wherein each of the pin inserting parts is provided with a stamped out part for clamping the pin in cooperation with the elastic contact piece.

3. The connector according to claim 1, further comprising:

a locking projection, wherein the locking projection interacts with a locking arm on the receiving chamber of the initiator.

4. The connector according to claim 3, further comprising:

a slider, wherein the slider is displaced from a first position by the locking arm during insertion of the housing into the initiator, and the slider returning to the first position after insertion, thereby preventing movement of the locking arm.

5. The connector according to claim 4, wherein the slider is biased in a first position by a spring.

* * * * *